US006230682B1

(12) United States Patent
Gustafsson et al.

(10) Patent No.: US 6,230,682 B1
(45) Date of Patent: May 15, 2001

(54) COMBUSTION ENGINE AND METHOD OF CONTROLLING SAME

(75) Inventors: Krister Gustafsson, Stockholm; Börje Grandin, Älvsjö; Tore Levin, Sollentuna, all of (SE)

(73) Assignee: Scania CV Aktiebolag (publ) (SE)

( * ) Notice: Subject to any disclaimer, the term of this patent is extended or adjusted under 35 U.S.C. 154(b) by 0 days.

(21) Appl. No.: 09/381,073

(22) PCT Filed: Mar. 11, 1998

(86) PCT No.: PCT/SE98/00436

§ 371 Date: Sep. 13, 1999

§ 102(e) Date: Sep. 13, 1999

(87) PCT Pub. No.: WO98/41746

PCT Pub. Date: Sep. 24, 1998

(30) Foreign Application Priority Data

Mar. 14, 1997 (SE) ..... 9700982

(51) Int. Cl.[7] ..... F02D 9/06
(52) U.S. Cl. ..... 123/323; 60/605.2
(58) Field of Search ..... 123/323; 60/605.2

(56) References Cited

U.S. PATENT DOCUMENTS 4,363,301 * 12/1982 Stock et al. ..... 123/323
4,671,226 * 6/1987 Van Rinsum ..... 123/323
4,872,434 * 10/1989 Sekiyama ..... 123/323
5,733,219 * 3/1998 Rettig et al. ..... 123/323
5,899,828 * 5/1999 Yamazaki et al. ..... 123/323
6,007,392 * 12/1999 Motose ..... 123/323
6,085,524 * 7/2000 Persson ..... 123/323

FOREIGN PATENT DOCUMENTS 0080327 6/1983 (EP) .
0180332 5/1986 (EP) .
0531277 3/1993 (EP) .
0658691 6/1995 (EP) .

* cited by examiner

*Primary Examiner*—John Kwon
(74) *Attorney, Agent, or Firm*—Ostrolenk, Faber, Gerb & Soffen, LLP

(57) ABSTRACT

A combustion engine has a line (20) for feeding exhaust gases back from the outlet system (3, 3) to the inlet system (2), an EGR valve (17) in the line (20), an exhaust brake valve (50) in the outlet system to increase the pressure in the outlet system upstream therefrom, and a control system (32) for controlling the degree of opening and closing of the valves (17, 50) on the basis of signals which represent the engine's operating state. The control system (32) holds the EGR valve (17) open and the exhaust brake valve (50) in a position which substantially throttles the exhaust gas flow so long as a first signal indicates that the engine has, during its starting, not yet reached a steady operating state. The result is a particularly simple way of appreciably shortening the time the engine takes to reach a steady operating state from a cold start and a corresponding reduction in discharge of emissions.

16 Claims, 2 Drawing Sheets

COMBUSTION ENGINE AND METHOD OF CONTROLLING SAME

The present invention relates to a combustion engine and a method of controlling same.

BACKGROUND AND STATE OF THE ART

In order to hasten the warming up of a combustion engine from a cold start, a known practice in the case of diesel engines in heavy vehicles is to increase the pressure in the exhaust system by blocking the exhaust line by means of an exhaust brake damper usually incorporated in the exhaust line of such vehicles.

The resulting increase in the load on the engine makes it reach its normal working temperature more quickly, thereby also reducing the discharge of emissions and of so-called white smoke.

Another known practice is to incorporate a line which connects the inlet and outlet systems of a combustion engine to one another in order to transfer exhaust gases from the outlet system to the inlet system. This line is usually valve-controlled in order to be able to modify according to the operating state of the engine the quantity of exhaust gases fed back to the inlet side of the engine. Exhaust gas feedback, also known as EGR (exhaust gas recirculation), is desirable during certain operating states in order to be able to hold down the engine's combustion temperature and thereby reduce the quantity of emissions from the engine.

Known technology has hitherto been unable, however, to indicate an effective method and device for appreciably reducing exhaust emissions during cold starting of combustion engines, particularly in the case of diesel-type combustion engines.

OBJECT OF THE INVENTION

The object of the invention is to provide a method and a device which appreciably reduce exhaust emissions during cold starting of combustion engines, particularly in the case of diesel-type combustion engines.

The solution has to be simple, economic and operationally reliable.

SUMMARY OF THE INVENTION

The object of the invention is achieved by holding the EGR valve open and the exhaust brake in a throttling position to throttle the exhaust gas flow so long as the engine, during a starting period, has not reached a steady operating state. Controlling an exhaust brake valve and an EGR valve in the manner therein indicated makes it possible to shorten appreciably the time the engine takes to reach a steady operating state from a cold start. A corresponding decrease in the discharge of emissions follows therefrom.

A simple solution according to the invention is also achieved by using the sensor signals already available in the case of an electronically controlled engine which represent parameters referring to fuel input quantity, engine speed and the likewise monitored parameter which represents the vehicle's speed. Further reduction of emissions can be achieved by controlling opening and closing of valves in dependence of the number of turns during starting of the engine.

Other features and advantages of the present invention will become apparent from the following description of the invention which refers to the accompanying drawings.

DESCRIPTION OF AN EMBODIMENT

Figure 1:
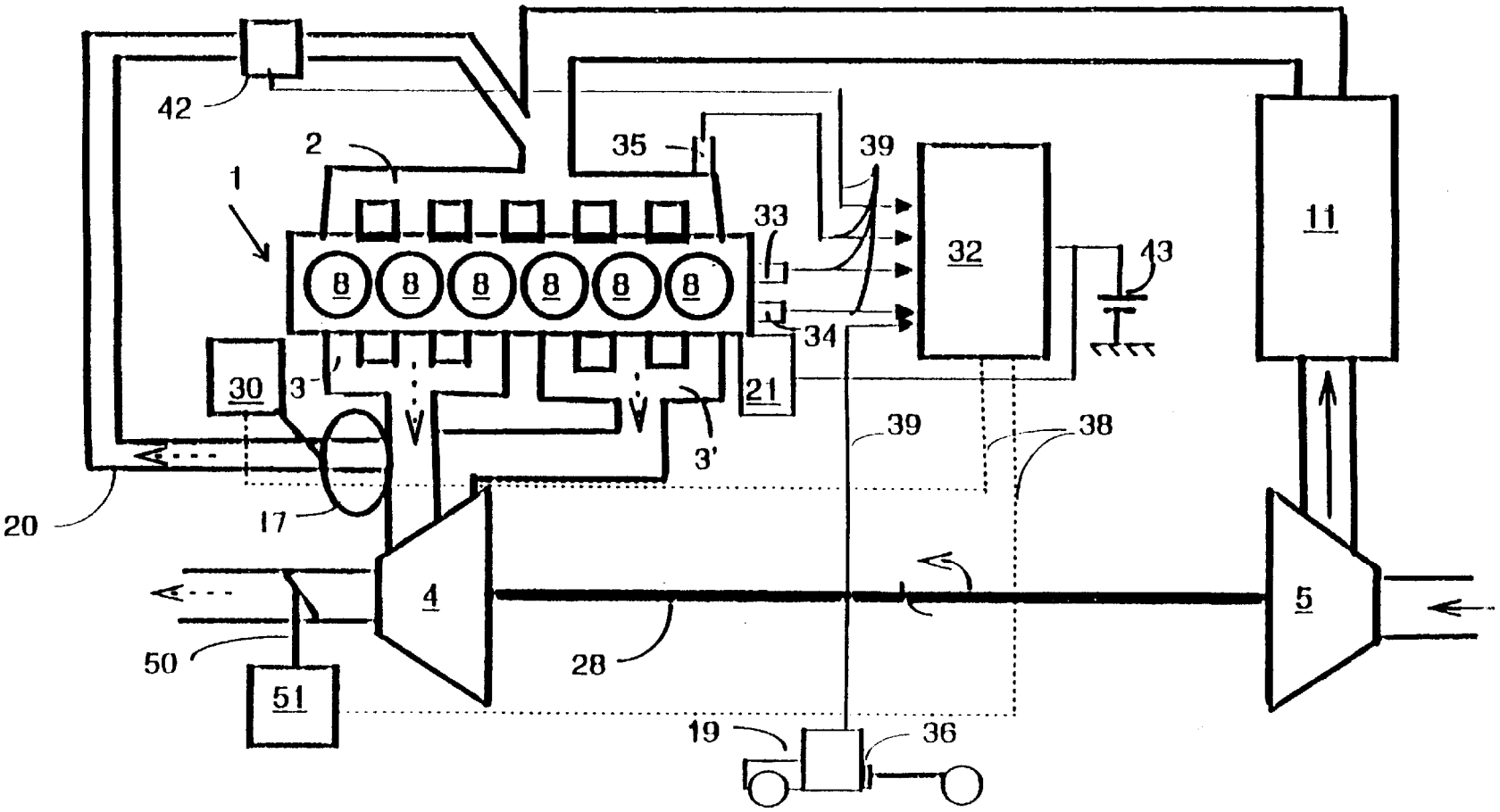
FIG. 1 shows schematically a system according to one embodiment of the invention for exhaust gas feedback in a turbocharged diesel engine.

FIG. 1 depicts a turbo-supercharged multi-cylinder combustion engine 1, preferably of diesel type. The supercharging of the engine is effected by a first turbo unit in which a turbine 4 driven by exhaust gases drives a compressor 5. The turbine 4 and the compressor 5 are coupled for joint rotation on a common drive shaft 28. In the diagram the inlet air flow is represented by unbroken flow arrows, whereas the exhaust gas flow is represented by discontinuous flow arrows.

The exhaust gases from the combustion engine are gathered in an exhaust manifold 3,3' which is here divided into two separate branches 3 and 3' respectively which connect to the inlet of the turbine 4. The turbine 4 is conventionally provided with a so-called divided inlet run so that exhaust pulses from one group of engine cylinders do not clash with pulses from the cylinders in the other group. Downstream from the turbine 4 there is also an exhaust brake 50, here of the damper valve type, which is acted upon by a control device 51 between a position which applies minimum throttling to the flow through the exhaust line (valve open) and a corresponding maximum throttling position (valve closed).

The inlet manifold 2 of the combustion engine conveys the air pressurised in the compressor 5 to the engine cylinders 8 in a conventional manner. In a manner likewise known per se, a charge air cooler 11 is arranged downstream from the compressor 5 but upstream from the inlet manifold 2. Also in a conventional manner, the inlet side of the compressor 5 is supplied with filtered air.

A pipeline 20, hereinafter called the EGR line, connects the outlet system upstream from the turbine 4 (advantageously directly from the exhaust manifold 3,3' or the turbine inlet) with the inlet system downstream from the compressor 5 (advantageously directly to the inlet manifold 2). The EGR line incorporates a valve 17 which is acted upon by a control device 30 which controls the degree of opening (including closure) of the valve in a conventional manner on the basis of signals from a control unit 32 for an electronic control system for the engine.

It is advantageous for the valve 17 to be situated close to the point at which the EGR line is tapped from the exhaust manifold, with the result that no exhaust gas volume in the EGR line need be compressed when the EGR line is closed. The consequences include no impairment of response during conventional exhaust braking or conventional engine load increase.

Figure 2:
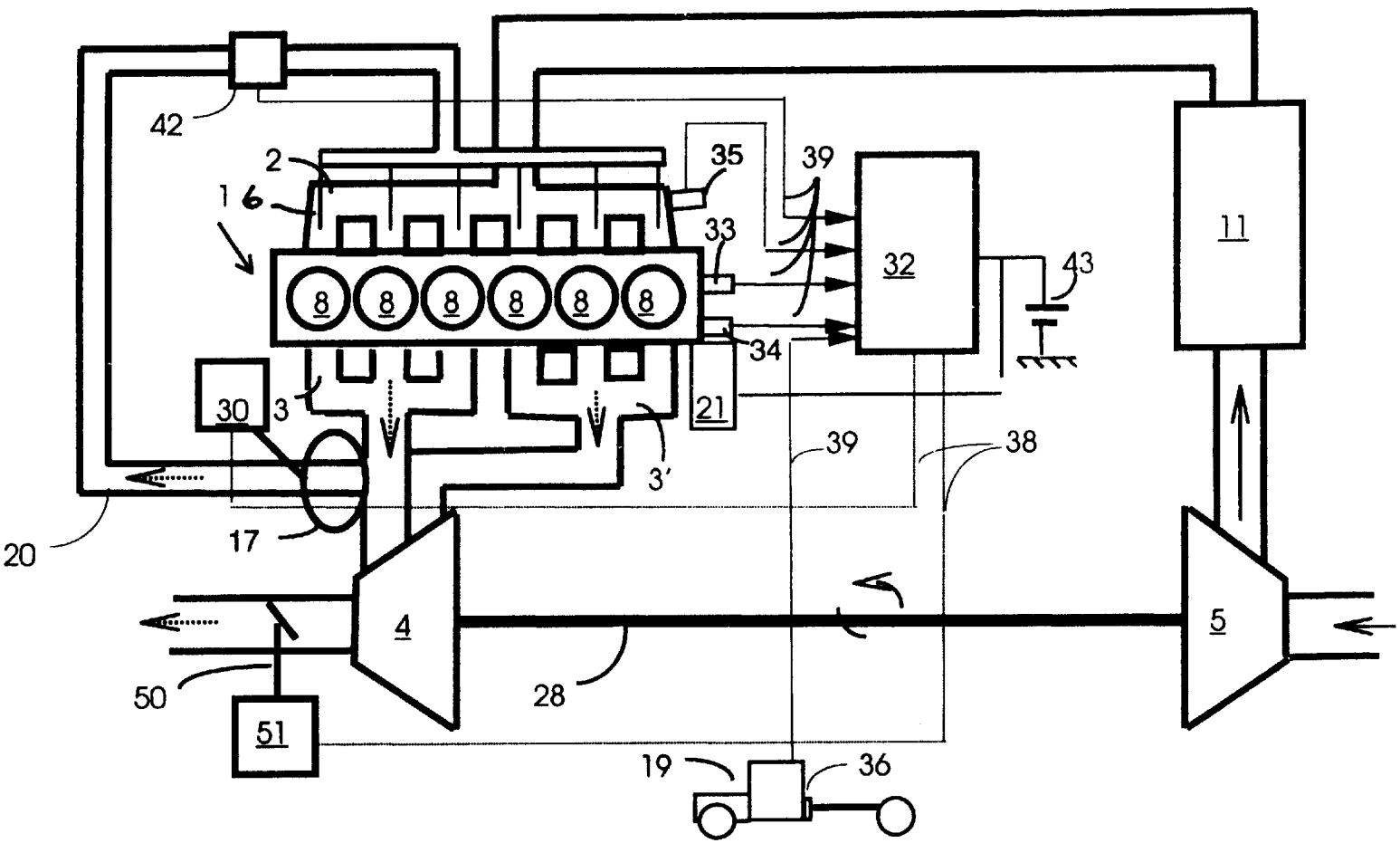
FIG. 2 shows schematically a system according to another embodiment of the invention for exhaust gas feedback in a turbo charged diesel engine.

In the solution depicted, the EGR line is directly connected to the inlet manifold 2 centrally or to the inlet air line connected thereto, in such a manner that the exhaust gases fed back are well mixed with the inlet air. It is possible with advantage, however, for the EGR line 20 alternatively, as shown in FIG. 2, to be connected to the inlet manifold 2 via a multiplicity of pipe orifices or apertures distributed so as to correspond to the connections of the inlet manifold 2 to the respective cylinder inlet ports.

The control unit 32 controls the control device 30 and hence the valve 17 on the basis of monitored engine and vehicle parameters such as engine speed, engine temperature and charge air pressure which together represent the operating state of the engine and the speed of the vehicle. These parameters are monitored by the control unit 32 via respective sensors 33,34,35 and 36 arranged on the engine and the vehicle. The vehicle speed sensor 36 appears in the diagram on a schematically depicted vehicle 19. Moreover, a flow sensor 42 which may for example incorporate a venturi meter in the line 20 provides the control unit 32 with a signal representing the EGR quantity delivered. This signal, like those representing the engine parameters, are received by the control unit 32 via signal input lines 39. On the basis thereof the control unit 32 controls the control devices 30 and 51 by means of signals via dotted control lines 38. Power supply to the control unit 32 and also to a conventional electric starter motor 21 intended for starting the engine is provided by a battery 43.

During engine starting, the starter motor 21 in a conventional manner makes the engine rotate at a speed of about 60 rev/min before any combustion takes place in any of the engine cylinders. At this stage both the exhaust brake valve 50 and the EGR valve 17 are closed in order to create maximum load on the engine and hence compression and heat build-up in the cylinders. The engine is supplied with fuel after the starter motor has made the engine rotate a few (approximately three) turns. At this stage, even when starting in very cold conditions (temperatures of the order of −20° C.) the heat built up in the cylinders is usually sufficient for the injected fuel to ignite. After a few (approximately three) more turns, the EGR valve 17 opens so that exhaust gases from the combustion which has taken place can be fed back via the EGR line 20 to the engine inlet air manifold 2. Said few more turns may also be detected from the occurrence of a predetermined increase in the engine speed relative to the starter motor speed. The exhaust gases thus fed back via the EGR line are mixed with the cold inlet air and led thereafter into the engine cylinders. The resulting inlet air thus has a higher temperature which appreciably facilitates the ignition of the fuel being injected into the cylinders. The greater the number of the engine cylinders in which this takes place, the greater will be the increase in exhaust gas feedback, resulting in the combustion in the cylinders reaching a normal state more quickly, thereby also achieving a desirable reduction in discharges of harmful emissions.

When the engine speed has for a certain predetermined time been held within certain limits which correspond to normal idling speed, the EGR gas flow is reduced by gradual closing of the EGR valve and likewise gradual opening of the exhaust brake valve. At this stage the starter motor also ceases to drive the combustion engine. In tests on a diesel engine for operating heavy vehicles, said predetermined time was about 10 seconds and the speed limits were 575 rev/min and 625 rev/min, i.e. a idling speed of 600 rev/min±25 rev/min.

The proportion of EGR gases fed back should not exceed about 50% by weight of the engine's air requirement. It may with advantage be of the order of 33% by weight at the beginning of the starting process when the EGR valve has opened and may subsequently be lowered to the order of 25% by weight when the engine has maintained a steady idling speed for the aforesaid predetermined time. Thereafter the EGR valve begins to gradually close the EGR line but full closure of the EGR line and full opening of the exhaust brake valve are only reached when the idling speed has for a predetermined time as described above been held within preselected limits with regard to variation and absolute level. Alternatively, the fact that the engine has reached a certain predetermined working temperature such as that represented by the coolant temperature may be the criterion which decides when the EGR valve and the exhaust brake valve will close and open respectively.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Method for controlling a combustion engine having an inlet system, an outlet system, an EGR (Exhaust Gas Recirculation) line for feeding exhaust gases back from the outlet system to the inlet system, an EGR valve in the EGR line, an exhaust brake valve in the outlet system to increase the pressure in the outlet system upstream therefrom, the method comprising holding the EGR valve open and the exhaust brake valve in a throttling position which substantially throttles the exhaust gas flow so long as the engine, during a starting period, has not reached a steady operating state.

2. Method according to claim 1, wherein the EGR valve is held open and the exhaust brake in the throttling position so long as the engine speed is below or close to an idling speed of the engine.

3. Method according to claim 1, wherein the EGR valve is held open and the exhaust brake valve in the throttling position so long as a working temperature of the engine is below a predetermined value.

4. Method according to claim 1, further comprising a control system for controlling the EGR valve and the exhaust brake valve and sensors on the engine for supplying first and second signals thereto representing engine speed and working temperature, respectively, and wherein the control system determines whether the engine has reached a steady operating state from the first and second signals.

5. Method according to claim 4, wherein the control system determines the engine has not reached a steady operating state so long as the first signal represents a value which indicates that the engine speed is below or close to an idling speed of the engine.

6. Method according to claim 4, wherein the control system determines the engine has not reached a steady operating state so long as the second signal represents a value which indicates that a working temperature of the engine is below a predetermined value.

7. Method for controlling a multi-cylinder diesel engine for driving a vehicle, the engine having an inlet system for receiving inlet air, an outlet system, an EGR (Exhaust Gas Recirculation) line for feeding exhaust gases back from the outlet system to the inlet system, an EGR valve in the EGR line, an exhaust brake valve in the outlet system to increase the pressure in the outlet system upstream therefrom, and a control system for controlling the degree of opening and closing of the EGR and exhaust brake valves on the basis of input signals which represent the operating state of the engine and of the vehicle and are supplied to the control system from sensors on the engine and the vehicle, the method comprising supplying output signals from the control system to the EGR valve and the exhaust brake valve to the hold the EGR valve open and the exhaust brake valve in a position which substantially throttles the exhaust gas flow when the control system is supplied with a first input signal representing a vehicle speed of 0 (zero) km/h and with a second input signal indicating that the engine has, during its starting, not yet reached a steady operating state.

8. Method according to claim 7, wherein for a predetermined first number of engine revolutions from the beginning of the engine starting process the output signals from the control system hold the EGR valve closed and the exhaust brake valve in a position which substantially throttles the exhaust gas flow, after which the output signals from the control system open the EGR valve but continue to hold the exhaust brake valve in the substantially throttling position so long as the control system is supplied with said first and second input signals.

9. Method according to claim 8, wherein the engine has not yet reached a steady operating state so long as the second input signal indicates that the speed of the engine is below or close to an idling speed.

10. Method according to claim 8, wherein the engine has not yet reached a steady operating state so long as the second input signal indicates that a working temperature of the engine is below a predetermined value.

11. Method according any one of claims 7–10, which comprises beginning the supply of fuel to the engine after a second number of engine revolutions which is smaller than the first number of engine revolutions.

12. Method according to claim 11, wherein the proportion of exhaust gas flow to total air flow into the engine is greater at the beginning of the starting process than at the end.

13. Method according to claim 12, wherein the proportion of exhaust gas flow to total air flow is not more than 50% by weight of such total air flow.

14. Method according to claim 13, wherein the proportion of exhaust gas flow to total air flow is 33% by weight at the beginning of the engine starting process when the EGR valve has opened.

15. A combustion engine in a vehicle, with an inlet system, an outlet system, a plurality of cylinders, an EGR (Exhaust Gas Recirculation)-line for feeding exhaust gases back from the outlet system to the inlet system, an EGR valve in the EGR line, an exhaust brake valve in the outlet system to increase the pressure in the outlet system upstream therefrom, and a control system for controlling the degree of opening and closing the valves on the basis of signals which represent the operating state of the engine and of the vehicle and are supplied to the control system from sensors on the engine and the vehicle, wherein the EGR line is connected via a multiplicity of apertures to an inlet air manifold which forms part of the inlet system, the inlet system having a plurality of connections to respective inlet ports of the cylinders and the multiplicity apertures corresponding to said plurality of connections.

16. A combustion engine in a vehicle according to claim 15, wherein the outlet system includes an exhaust manifold and further comprising a supercharging unit having a turbine connected to the exhaust manifold, the EGR valve being positioned in the outlet system adjacent to the connection between the turbine and the exhaust valve.

* * * * *